US011583055B2

(12) United States Patent
Newman

(10) Patent No.: US 11,583,055 B2
(45) Date of Patent: Feb. 21, 2023

(54) INSTRUMENT FOR REMOVING HAIRS

(71) Applicant: Catherine Newman, Oakland, CA (US)

(72) Inventor: Catherine Newman, Oakland, CA (US)

( * ) Notice: Subject to any disclaimer, the term of this patent is extended or adjusted under 35 U.S.C. 154(b) by 482 days.

(21) Appl. No.: 16/591,339

(22) Filed: Oct. 2, 2019

(65) Prior Publication Data

US 2020/0107625 A1 Apr. 9, 2020

Related U.S. Application Data

(60) Provisional application No. 62/741,101, filed on Oct. 4, 2018.

(51) Int. Cl.
*A45D 26/00* (2006.01)

(52) U.S. Cl.
CPC ..... *A45D 26/0038* (2013.01)

(58) Field of Classification Search
CPC ..... A45D 26/00; A45D 26/0023; A45D 26/0028; A45D 26/0035; A45D 26/0042; A45D 26/0047; A45D 26/0057; A45D 26/0066; A45D 26/0071; A61B 2018/00476
See application file for complete search history.

(56) References Cited

U.S. PATENT DOCUMENTS 477,019 A * 6/1892 Neustadt ..... B26B 27/002 30/116
591,970 A * 10/1897 Hoffman ..... B26B 27/002 30/116
1,144,282 A * 6/1915 Araki ..... B26B 27/002 30/116
3,150,409 A * 9/1964 Wilcox ..... A22B 5/16 30/34.2
4,524,772 A * 6/1985 Daar ..... A45D 26/0052 132/73
4,960,421 A * 10/1990 Daar ..... A45D 26/0052 606/133
5,011,485 A * 4/1991 Daar ..... A45D 26/0052 606/133
5,437,100 A * 8/1995 Oberloier ..... B28B 11/14 30/294
D566,333 S * 4/2008 Shoavi ..... D28/44.1
2008/0190629 A1* 8/2008 Zeyger ..... A01B 1/16 172/378
2009/0240260 A1* 9/2009 Yang ..... A45D 26/0028 606/133
2012/0260506 A1* 10/2012 Kimsey ..... B26B 27/002 30/278
2015/0135539 A1* 5/2015 Harris ..... A47J 25/00 30/122
2019/0009011 A1* 1/2019 Brown ..... B08B 9/027

FOREIGN PATENT DOCUMENTS

CH 368696 * 5/1950 ..... A45D 26/0047
TW M452671 U1 * 5/2013 ..... A45D 27/00

* cited by examiner

*Primary Examiner* — Robert A Lynch
(74) *Attorney, Agent, or Firm* — Perkins Coie LLP

(57) ABSTRACT

The present embodiments relate to a hair removal tool. The tool may include a coil that is tightly wound and engaged to a housing. In operation, a user may roll the coil across a substrate (e.g., skin) to capture hairs between the coils in the coil. As the coil rolls radially around the housing, the outer edge of the coil can expand and contract, capturing and removing hairs as the coil rolls.

20 Claims, 6 Drawing Sheets

INSTRUMENT FOR REMOVING HAIRS

CROSS REFERENCE TO RELATED APPLICATIONS

The present patent application claims the benefit of U.S. Provisional Patent Application Ser. No. 62/741,101 entitled "AN INSTRUMENT FOR REMOVING BODY HAIR," and filed Oct. 4, 2018, which is incorporated by reference herein in its entirety.

TECHNICAL FIELD

This disclosure relates to a hair removal instrument, and, in particular, to a hair removal instrument using a coil that can capture hair between each coil.

BACKGROUND

In many cases, it is desirable to remove hairs from specific portions of skin for various aesthetic reasons. For example, a user might want to remove sections of hair near their eyes.

Various devices may include components that can trim these undesired hairs. However, trimming hair generally does not remove the follicle of the hair. Consequently, the undesired hairs may grow back in a short time duration or leave the user with a visually undesired result.

Other hair removal devices, such as tweezers or wax, may remove undesired hairs at the follicle in a manner undesirable to the user.

Additionally, some devices may require the use of two hands of the user, which may reduce user experience.

BRIEF DESCRIPTION OF THE DRAWINGS

Various features and characteristics of the technology will become more apparent to those skilled in the art from a study of the Detailed Description in conjunction with the drawings. Embodiments of the technology are illustrated by way of example and not limitation in the drawings, in which like references may indicate similar elements.

Figure 1:
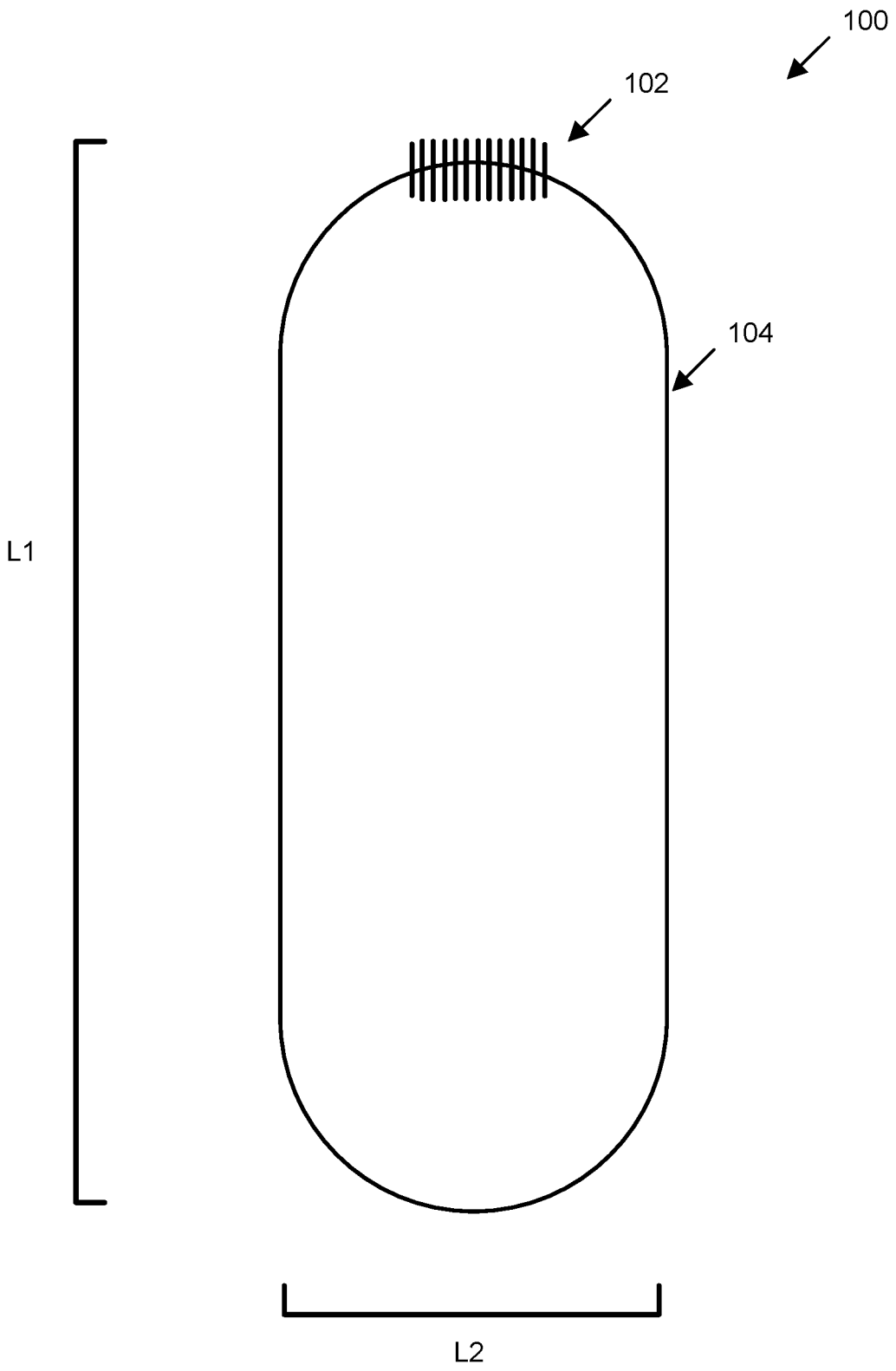
FIG. 1 is a perspective view of a hair removal tool, in accordance with various embodiments.

The drawings depict various embodiments for the purpose of illustration only. Those skilled in the art will recognize that alternative embodiments may be employed without departing from the principles of the technology. Accordingly, while specific embodiments are shown in the drawings, the technology is amenable to various modifications.

DETAILED DESCRIPTION

The embodiments set forth below represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. These concepts and applications fall within the scope of the disclosure and the accompanying claims.

Terminology

The purpose of terminology used herein is only for describing embodiments and is not intended to limit the scope of the disclosure. Where context permits, words using the singular or plural form may also include the plural or singular form, respectively.

As used herein, terms such as "connected," "coupled," or the like, may refer to any connection or coupling, either direct or indirect, between two or more elements. The coupling or connection between the elements can be physical, logical, or a combination thereof.

References to "an embodiment" or "one embodiment" means that the particular feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the words "comprise" and "comprising" are to be construed in an inclusive sense rather than an exclusive or exhaustive sense (i.e., in the sense of "including but not limited to").

The term "based on" is also to be construed in an inclusive sense rather than an exclusive or exhaustive sense. Thus, unless otherwise noted, the term "based on" is intended to mean "based at least in part on."

When used in reference to a list of multiple items, the word "or" is intended to cover all of the following interpretations: any of the items in the list, all of the items in the list, and any combination of items in the list.

The sequences of steps performed in any of the processes described herein are exemplary. However, unless contrary to physical possibility, the steps may be performed in various sequences and combinations. For example, steps could be added to, or removed from, the processes described herein. Similarly, steps could be replaced or reordered. Thus, descriptions of any processes are intended to be open-ended.

Overview

In many cases, users want to remove hairs from specific portions of their skin for various reasons. For example, a user might want to remove sections of hair near their eyes.

To remove undesired hairs, the user may utilize a hair trimmer. However, hair trimmers generally do not remove the follicle of the hair, but rather, only trim the hair length. Consequently, the undesired hairs may grow back in a short time duration or leave the user with a visually undesired result.

Additionally, other devices, such as tweezers or wax, may remove undesired hairs at the follicle in a manner undesirable to the user.

Further, some devices may require the use of two hands of the user, which may reduce user experience.

System Overview

The present embodiments relate to a hair removal tool. The tool may include a coil that is tightly wound and engaged to a housing. In operation, a user may roll the coil across a substrate (e.g., skin) to capture hairs between individual coils. As the coil rolls radially around the housing, the outer edge of the coil can expand and contract, capturing and removing hairs as it rolls.

The hair removal tool as described herein may facilitate removal of hairs with greater ease and increased user experience. Particularly, as the user rolls the coil over skin, hairs may be removed with ease. Additionally, the hair removal tool may be operated using only one hand of a user, increasing user experience.

FIG. 1 is a perspective view of a hair removal tool 100, in accordance with various embodiments. As shown in FIG. 1, tool 100 may include a coil 102 and a housing 104.

Coil 102 may include a coil that includes a plurality of tightly-wound coils. The coil 102 is configured to engage with the housing 104 and roll relative to the housing 104. The coil 102 is discussed in greater detail with respect to FIG. 2.

Housing 104 may engage with coil 102 to facilitate the rolling of coil 102. Particularly, a portion of the housing 104 may be surrounded by the coil 102, where the coil 102 can roll relative to the portion of the housing 104. The housing can include a metal or metal-alloy material.

The housing 104 may include any of a plurality of shapes. In the example as shown in FIG. 1, the housing 104 may be substantially elliptical in shape. The housing 104 may include other shapes, such as circular, square, rectangular, 'u' shaped, etc. In some embodiments, the housing 104 may allow for the user to operate the tool 100 with one hand.

The tool 100 can include length L1 and width L2. As an example, the tool 100 length L1 can be around 1.875 inches. Width L2 can be around 0.375 inches.

Figure 2:
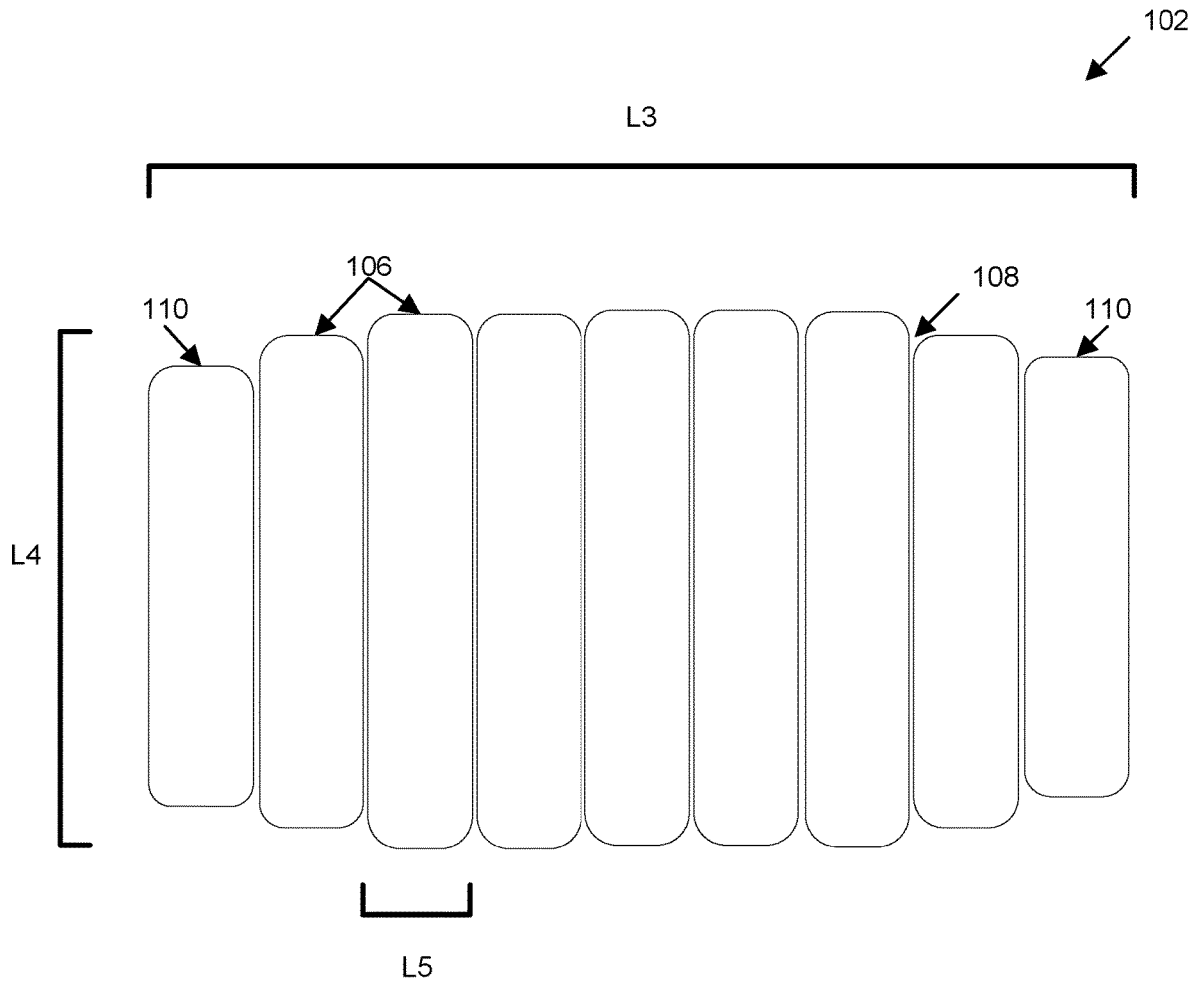
FIG. 2 illustrates a perspective view of a coil, in accordance with various embodiments.

FIG. 2 illustrates a perspective view of a coil 102, in accordance with various embodiments. As shown in FIG. 2, the coil 102 may include a plurality of individual coils 106 spiraling around an axis. Each individual coil 106 may be separated by space 108. Space 108 may be narrow so as to capture hairs at each space 108, which is discussed with respect to FIG. 3 below.

In some embodiments, the coil 102 may be substantially barrel shaped. In some embodiments, the coil may have a length L3 of around 5/32 inches. The coil 102 may include a number of stepped down coils 110 at each end of the coil 102. For example, coil 102 can include two stepped down coils 110 at each end of the coil 102. In some embodiments, the coil 102 may include tapered ends that help the coil 102 follow a curve of the housing and elongate along the outer edge of the coil 102.

The coil 102 may be configured to roll around a housing 104 in a radial direction. In operation, the coil 102 may stay in place relative to the housing 104 when rolling. When rolling, the coil may perform a cycle that includes elongating and retracting through portions of the coil.

The coil 102 may include a suitable number of individual coils. For example, the coil 102 may include 12 full coils and two stepped down coils on each side of the coil 102 with a reduced size relative to the full coils. The coil 102 may include an outer diameter (OD) and an inner diameter (ID). For example, the outer diameter of the coil 102 may include 0.075 inches or less. The coil 102 may include an inner diameter that steps down to 0.040 inches, which may roll around a 0.04 inch rod.

In some embodiments, the coil 102 includes 12 coils with a 0.075 inch OD and a 0.009 inch wire rod. The coil 102 may also include two stepped down coils on each side of the coil 102, one with a first 0.067 inch OD and a second with a 0.058 inch OD.

In some embodiments, the coil 102 includes 12 coils with a 0.075 inch OD and a 0.010 inch rod. The coil 102 may also include two stepped down coils on each side of the coil 102, one with a first 0.068 inch OD and a second with a 0.060 inch OD.

In some embodiments, the coil 102 includes 12 coils with a 0.075 inch OD and a 0.011 inch rod. The coil 102 may also include two stepped down coils on each side of the coil 102, one with a first 0.069 inch OD and a second with a 0.062 inch OD.

Coil 102 may include length L4 representing the height of the coil 102. Length L4 may include a minimum length that allows the coil 102 to roll about the housing 104.

The individual coils 106 of the coil 102 may include a gauge of each coil, which may be represented by width L5 of each individual coil 106. The gauge can range from a 0.008 to a 0.015 inch rod. In some embodiments, the coil 102 includes a rod of 0.010 or 0.011 inches.

The coil 102 may include a metal material. In some embodiments, the coil 102 may include a soap-coated 302SS (stainless steel) that is passivated & deburred. In some embodiments, the coil 102 is 316SS (stainless steel). In some embodiments, the tool 100 may include a material (e.g., a metal) that is medical-grade or food-grade.

Figure 3:
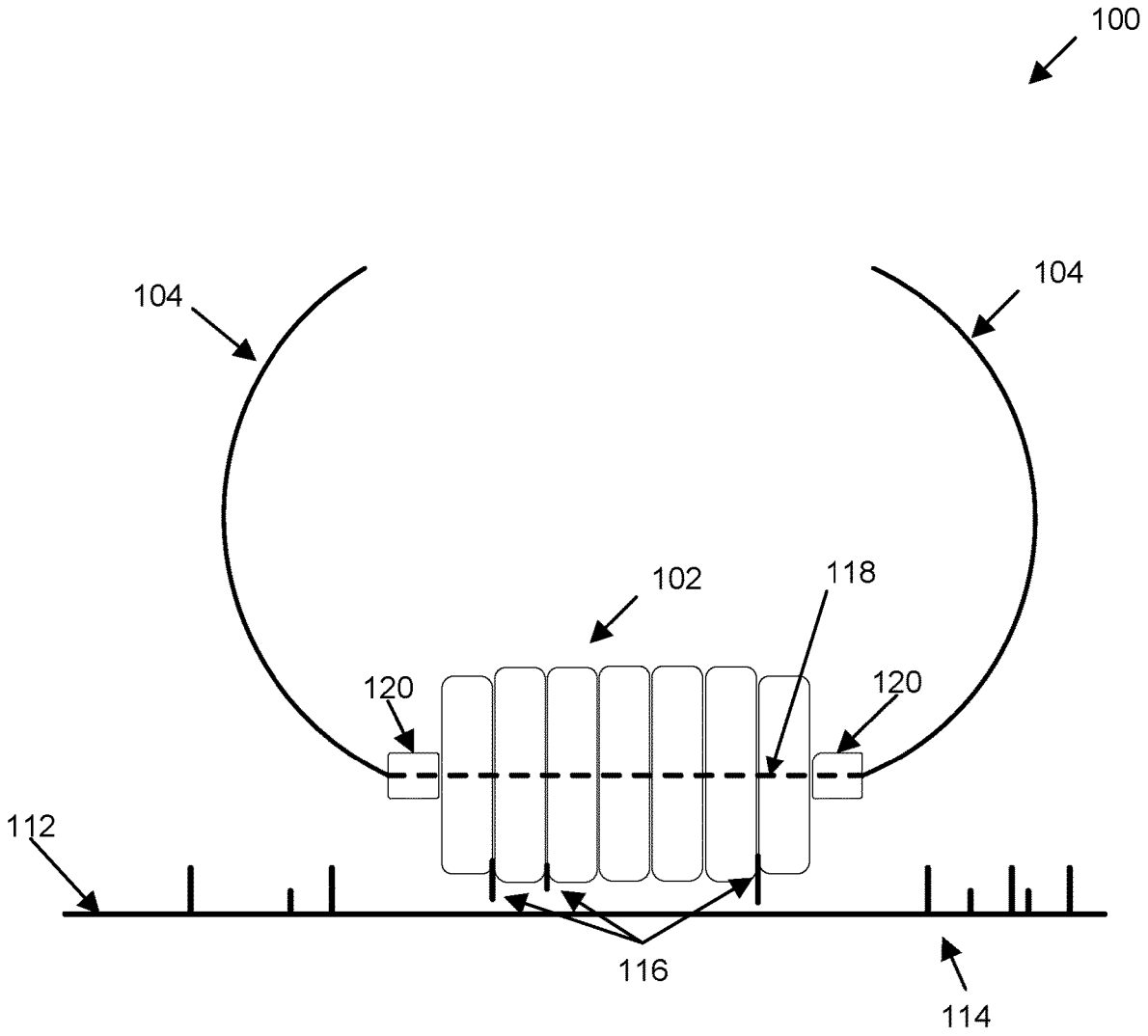
FIG. 3 illustrates a perspective view of the hair removal tool in operation, in accordance with various embodiments.

FIG. 3 illustrates a perspective view of the hair removal tool 100 in operation, in accordance with various embodiments. As noted above, in operation, the coil 102 of the tool 100 may roll across a substrate 112 (e.g., skin) that includes hairs 114. As the coil 102 rolls across the substrate 112, trapped hairs 116 may be captured between the individual coils of the coil 102. This may facilitate removal of the entirety of hairs 116 rather than simply trimming hair length.

Further, in operation, a user may grip the housing 104 using one hand. For example, the user may grip handle portions of the housing 104 using their fingers, as illustrated in FIG. 3. The housing may include a crossbar 118 that is surrounded by the coil 102 and facilitates the rotation of the coil 102 about the crossbar 118.

The tool 100 may include spacers 120 on each side of the coil 102. Spacers 120 may be engaged to the housing 104 and keep the coil 102 in place while facilitating rotation of the coil 102. Spacers 120 can be affixed (e.g., soldered, adhered) to the housing 104.

Figure 4:
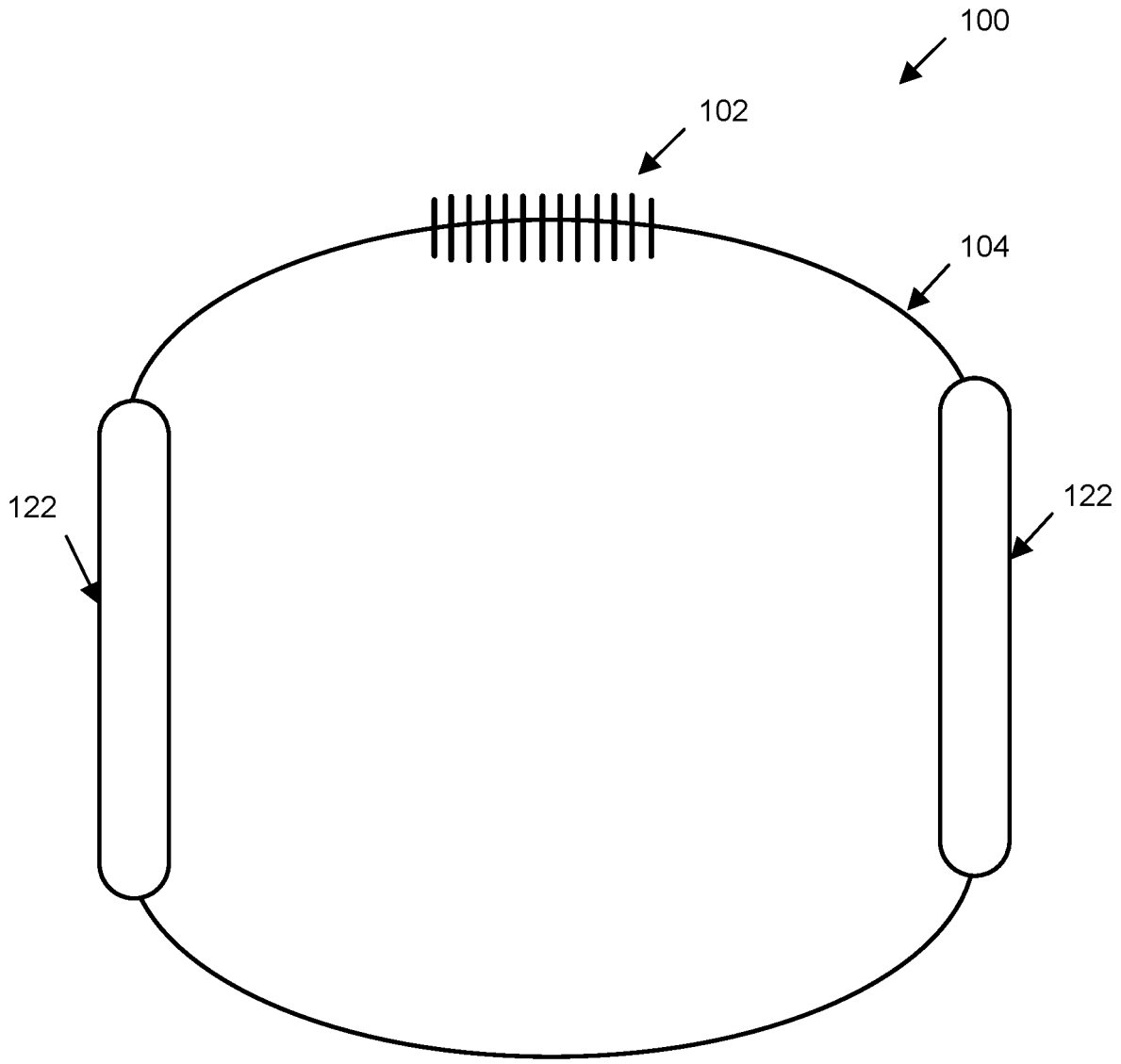
FIG. 4 is a perspective view of a hair removal tool, in accordance with various embodiments.

FIG. 4 is a perspective view of a hair removal tool 100, in accordance with various embodiments. As shown in FIG. 4, the housing 104 can be substantially circular in shape.

The tool 100 may include an outer shell 122 surrounding at least a portion of the housing 104. The outer shell 122 (or "heatshrink") may include a flexible material that increases user experience when gripping the tool 100. For example, the outer shell 122 may include a plastic material.

Figure 5:
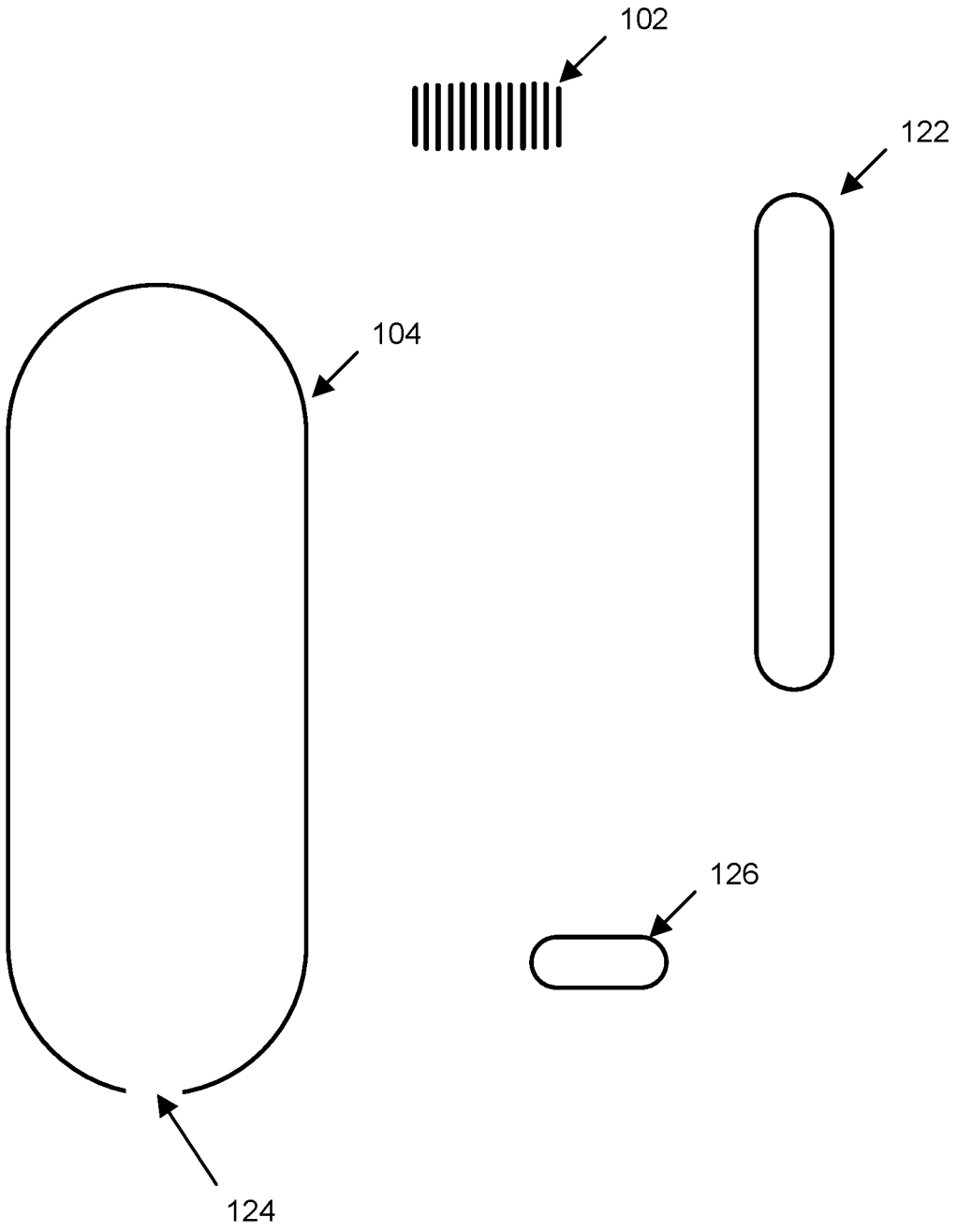
FIG. 5 illustrates a perspective view of separated components for a hair removal tool, in accordance with various embodiments.

FIG. 5 illustrates a perspective view of separated components for a hair removal tool, in accordance with various embodiments. As shown in FIG. 5, the components (e.g., 102, 104, 118) can be integrated to form the hair removal tool 100.

In some embodiments, the coil 102 may be disposed around the housing 104. The coil 102 may fit around housing 104 using a gap 124 in the housing 104.

The outer shell 122 may fit around housing 104. In some embodiments, the outer shell 122 may be disposed around housing 104 via gap 124.

After the components (e.g., coil 102, outer shell 122) are engaged to the housing 104, the gap 124 may be closed using a spacer 126. Spacer 126 may assist in keeping all components (e.g., coil 102, outer shell 122) in the housing 104. In some embodiments, spacer 126 may include a collar, glue, solder, etc.

In some embodiments, the tool 100 may include print, such as instructions, suggestions, lists, comments, images, etc.

Figure 6:
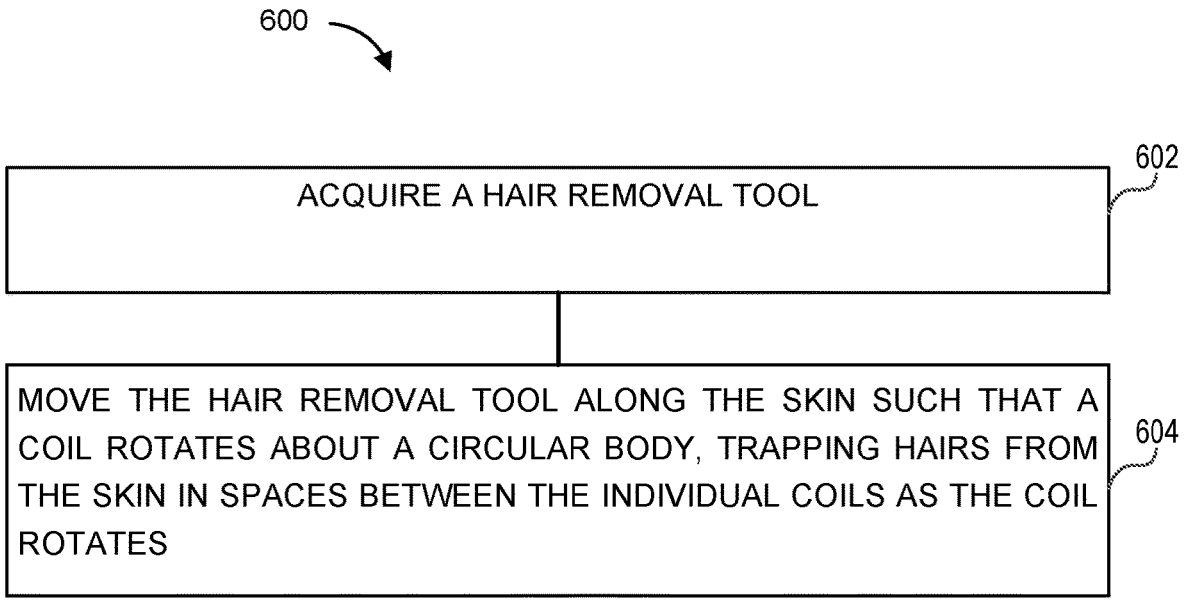
FIG. 6 illustrates a block diagram of a method for removing hairs from skin, in accordance with various embodiments.

FIG. 6 illustrates a block diagram of a method 600 for removing hairs from skin, in accordance with various embodiments. The method may include acquiring a hair removal tool (block 602). The hair removal tool may include a circular rod. In some embodiments, the body is substantially circular or substantially elliptical.

The hair removal tool may include a coil disposed around a portion of the circular rod, the coil may include a number of individual coils and stepped down coils on each of a first side and a second side of the coil.

The method may include moving the hair removal tool along the skin such that the coil rotates about the circular rod, trapping hairs from the skin in spaces between the individual coils as the coil rotates (block 604).

In some embodiments, the method may include disposing the coil through a gap formed in the circular rod. The method may include disposing a flexible outer shell around a second portion of the circular rod via the gap. The method may include closing the gap using a mechanical joining process (e.g., soldering or adhering the ends of the gap).

In some embodiments, the coil includes twelve full individual coils and two stepped down coils on each of a first side and a second side of the coil.

In some embodiments, each full individual coil includes an outer diameter of around 0.075 inches, and each stepped down coil includes an outer diameter between 0.059 inches and 0.069 inches. In some embodiments, each full individual coil includes an outer diameter of between 0.070 and 0.080 inches, the outer diameter of the second set of stepped down coils ranging between 0.060 and 0.070 inches, and the outer diameter of the first set of stepped down coils ranging between 0.055 and 0.065 inches. In some embodiments, the coil includes a length of between 0.14 and 0.20 inches.

In some embodiments, the tool includes a length of around 1.875 inches and a width of around 0.375 inches. In some embodiments, the tool includes a length of between 1.8 and 1.9 inches, and a width of between 0.300 and 0.400 inches. In some embodiments, the rod of the body includes a 0.04 inch rod form.

In some embodiments, the coil includes a rod gauge size of between 0.009 inches and 0.011 inches. In some embodiments, the coil includes a rod with a diameter of around 0.010 inches. In some embodiments, the coil includes soap-coated 302SS stain steel rod.

In some embodiments, the tool includes a flexible outer shell surrounding a second portion of the body. In some embodiments, the tool includes a gap formed in the elliptical body, the gap configured to receive the coil.

In some embodiments, the tool includes a set of spacers disposed on each of the first end and second end of the coil, the spacers configured to facilitate rotation of the coil while maintaining a position of the coil on the elliptical body.

From the foregoing, it will be appreciated that specific embodiments of the invention have been described herein for purposes of illustration, but that various modifications may be made without deviating from the scope of the invention. Accordingly, the invention is not limited except as by the appended claims.

What is claimed is:

1. A tool configured to remove hair from skin, the tool comprising:

a body comprising a rod, wherein the rod is substantially shaped in a form of an oblong ring, wherein the oblong ring includes:

a first straight portion including a first proximal end and a first distal end;

a second straight portion parallel to the first straight portion, the second straight portion including a second proximal end and a second distal end;

a first arced segment joining the first proximal end to the second proximal end, and a second arced segment joining the first distal end to the second distal end; and a coil including a plurality of individual coils and disposed around a first portion of the body within the second arced segment of the oblong ring, the coil configured to rotate about the body and to trap hairs from the skin in spaces between the individual coils as the coil rotates.

2. The tool of claim 1, wherein the plurality of individual coils includes:

twelve full individual coils; and two stepped down coils on each of a first side and a second side of the coil.

3. The tool of claim 2, wherein each full individual coil includes an outer diameter of 0.075 inches, and each stepped down coil includes an outer diameter between 0.059 inches and 0.069 inches.

4. The tool of claim 1, wherein the coil includes a rod diameter of between 0.009 inches and 0.011 inches.

5. The tool of claim 1, wherein the coil includes soap-coated 302SS stain steel rod.

6. The tool of claim 1, wherein the rod of the body includes a 0.04 inch diameter rod form.

7. The tool of claim 1, further comprising:

a flexible outer shell surrounding a portion of the body.

8. The tool of claim 1, further comprising:

a spacer positioned approximately opposite to the coil along the oblong ring, wherein a length of the spacer is less than a length of the rod.

9. The tool of claim 1, wherein the coil has a length between 0.14 and 0.20 inches, wherein the body has a length between 1.8 and 1.9 inches, and wherein the body has a width between 0.300 and 0.400.

10. An instrument to remove hair from skin, the instrument comprising:

body comprising a rod, wherein the rod is substantially shaped in a form of an oblong ring, wherein the oblong ring includes:

a first straight portion including a first proximal end and a first distal end;

a second straight portion parallel to the first straight portion, the second straight portion including a second proximal end and a second distal end;

a first arced segment joining the first proximal end to the second proximal end, and a second arced segment joining the first distal end to the second distal end; and a coil disposed on a portion of the body within the second arced segment of the oblong ring and configured to rotate about the body and to trap hairs from the skin in spaces between individual coils as the coil rotates, the coil including:

twelve full individual coils;

a first set of stepped down coils on each of a first end and a second end of the coil; and a second set of stepped down coils on each of the first end and the second end of the coil, an outer diameter of the second set of stepped down coils less than the full individual coils and the first set of stepped down coils.

11. The instrument of claim 10, wherein the coil includes a length of between 0.14 and 0.20 inches.

12. The instrument of claim 10, wherein each full individual coil includes an outer diameter of between 0.070 and 0.080 inches, the outer diameter of the second set of stepped down coils ranging between 0.060 and 0.070 inches, and the outer diameter of the first set of stepped down coils ranging between 0.055 and 0.065 inches.

13. The instrument of claim 10, wherein the instrument includes a length of between 1.8 and 1.9 inches, and a width of between 0.300 and 0.400 inches.

14. The instrument of claim 10, wherein the coil includes a rod size of around 0.010 inches in diameter.

15. The instrument of claim 10, further comprising:

a flexible outer shell surrounding a second portion of the body.

16. The instrument of claim 10, further comprising:

a gap formed in the body, the gap configured to receive the coil.

17. The instrument of claim 10, further comprising:

a set of spacers disposed on each of the first end and second end of the coil, the spacers configured to facilitate rotation of the coil while maintaining a position of the coil on the body.

18. A method for removing hairs from skin, the method comprising:

acquiring a hair removal tool that includes:

a body comprising a rod, wherein the rod is substantially shaped in a form of an oblong ring, wherein the oblong ring includes:

a first straight portion including a first proximal end and a first distal end;

a second straight portion parallel to the first straight portion, the second straight portion including a second proximal end and a second distal end;

a first arced segment joining the first proximal end to the second proximal end, and a second arced segment joining the first distal end to the second distal end; and a coil disposed around a portion of the body within the second arced segment of the oblong ring, the coil including a plurality of individual coils and stepped down coils on each of a first side and a second side of the coil; and moving the hair removal tool along the skin such that the coil rotates about the body, trapping hairs from the skin in spaces between the individual coils as the coil rotates.

19. The method of claim 18, further comprising:

disposing the coil through a gap formed in the body.

20. The method of claim 19, further comprising:

disposing a flexible outer shell around a second portion of the body via the gap; and mechanically joining ends of the gap to close the gap formed in the body.

* * * * *